US006120333A

United States Patent [19]

Ko

[11] Patent Number: 6,120,333

[45] Date of Patent: Sep. 19, 2000

[54] ELECTRIC CONNECTOR WITH TERMINAL RETAINING MEANS

[75] Inventor: David Tso-Chin Ko, Thousand Oaks, Calif.

[73] Assignee: Hon Hai Precision Ind. Co., Ltd., Taipei Hsien, Taiwan

[21] Appl. No.: 09/207,080

[22] Filed: Dec. 7, 1998

[51] Int. Cl.[7] ..... H01R 13/342

[52] U.S. Cl. ..... 439/748; 439/752.5

[58] Field of Search ..... 439/748, 746, 439/747, 749, 751, 752, 752.5, 733.1

[56] References Cited

U.S. PATENT DOCUMENTS 5,664,969 9/1997 Peterson et al. ..... 439/746

*Primary Examiner*—Lincoln Donovan
*Assistant Examiner*—Eugene G. Byrd
*Attorney, Agent, or Firm*—Wei Te Chung

[57] ABSTRACT

An electrical connector for connecting conductors of a conductive wire to a terminal of a complementary connector comprises a dielectric housing defining an array of terminal passageways therein. A dam upward extends from the terminal passageway. A wedge rearwardly extends from the dam thereby defining a retaining gap between an inner surface of the passageway and the wedge. Terminals are assembled in the terminal passageways and each has a mating portion adapted to mate with a corresponding terminal of the complementary connector. A tongue extends from the mating portion for being securely retained within the gap. A cavity is defined adjacent to the retaining gap for retaining an anchoring foot of the terminal.

11 Claims, 6 Drawing Sheets

ELECTRIC CONNECTOR WITH TERMINAL RETAINING MEANS

FIELD OF THE INVENTOR

The present invention relates to an electrical connector, and more particularly to an electrical connector with terminal retaining means for adequately and quickly positioning terminals therein.

DESCRIPTION OF PRIOR ART

A variety of mating connectors employ pairs of interengaging terminals for connecting conductive wires through mated connectors. The terminal pairs may be pin and socket terminals. Conventionally, terminals are assembled in an array of passageways of a dielectric housing of the connector. Each terminal is inserted into the corresponding passageways along a longitudinal axis of the passageway and retaining means integrally formed therewith securely retains the terminal therein.

Properly retaining the terminal in position within the passageway of the housing is problematic for such connectors. Instability of the terminals results in terminal movement within the housing, particularly transversely or angularly along longitudinal axes thereof. Transverse or angular movement of the terminal causes terminal-to-terminal misalignment between complementary connectors which may damage one or both of the mating terminals thereby resulting in partial or incomplete electrical connection. It is readily understood that pin and receptacle terminals must be properly positioned, stabilized and centered in order to accurately mate with corresponding receptacle and pin terminals. Such positioning has become more critical due to the increasing miniaturization of electrical connectors.

U.S. Pat. No. 5,664,969 (herein after referred to as '969) discloses an electrical connector adapted for connecting a conductor of an electrical wire to a terminal of a mating connector. The '969 discloses a pair of elongate slots defined in a wall of a cavity of a dielectric housing. The terminal is provided with a free end portion which can be slightly received within the slots. By this arrangement, the terminal inserted into the cavity is prevented from transverse or angular movement. However, the structure of both the cavity and terminal is complicated.

SUMMARY OF THE INVENTION

An objective of this invention is to provide an electrical connector with terminal retaining means for adequately and quickly positioning terminals therein.

In order to achieve the objective set forth, an electrical connector for connecting conductors of a conductive wire to a terminal of a complementary connector, comprises a dielectric housing having an array of terminal passageways defined therein. A dam upward extends from the terminal passageway. A wedge rearwardly extends from the dam thereby defining a retaining gap between an inner surface of the passageway and the wedge. Terminals are assembled in the terminal passageways and each terminal has a mating portion adapted to mate with a corresponding terminal of the complementary connector. A tongue extends from the mating portion for being securely retained within the gap. A cavity is defined adjacent to the retaining gap for retaining an anchoring foot of the terminal.

These and additional objectives, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1A:
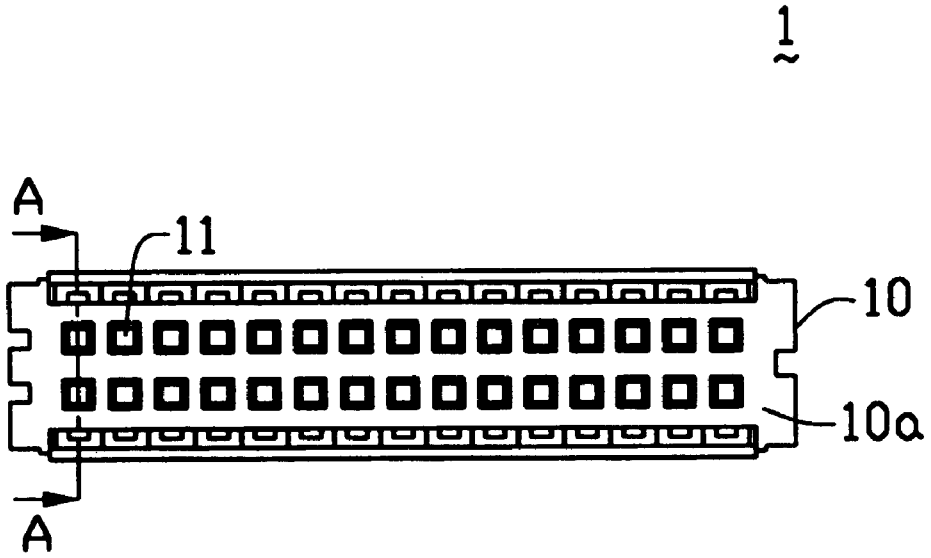
FIG. 1A is a front view of an electrical connector in accordance with the present invention.
Figure 1B:
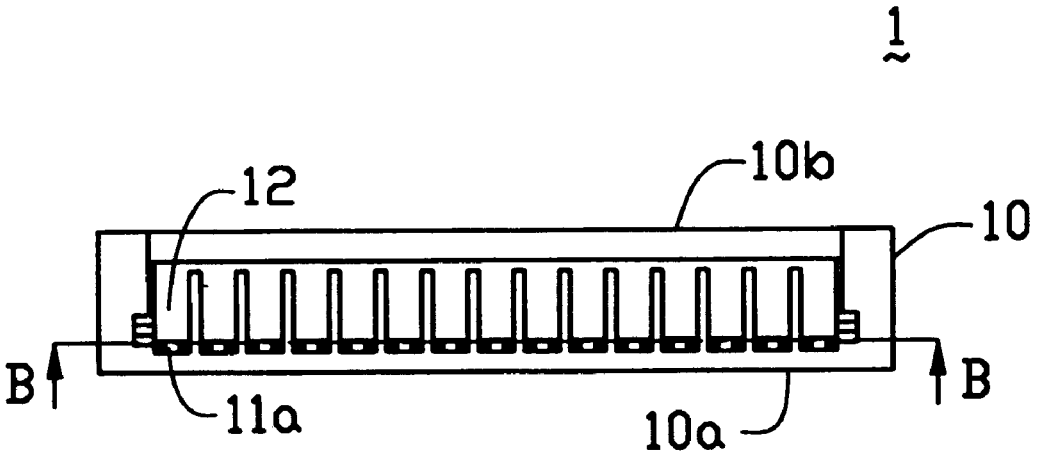
FIG. 1B is a top plan view of the electrical connector of FIG. 1A.

Referring to FIGS. 1A to 1E, a receptacle connector 1 comprises a dielectric housing 10 forming front and rear faces 10*a*, 10*b*. An array of terminal passageways 11 is defined between the front and rear faces 10*a*, 10*b*. Each upper passageway 11 is symmetrically arranged with the corresponding lower passageway 11. Each passageway 11 has an open ceiling 11*a* which is partially covered by a flap 12 cantilevered forward from the rear face 10*b*. The flap 12 forms a block 12*a* having a leading face 12*b* and a biasing face 12*c*. A retaining space 12*d* is defined between the biasing face 12*c* and the flap 12. Each passageway 11 defines front and rear openings 11*b*, 11*c* for receiving a receptacle terminal 30 (FIG. 2A, only one terminal 30 being assembled therein for simplicity) and a pin terminal (not shown) connected to the receptacle terminal 30. A dam 13 upward extends from the front opening 11*c*. A wedge 13*a* rearwardly extends from the dam 13 thereby defining a retaining gap 13*b* between an inner surface of the passageway 11 and the wedge 13*a*.

Figure 2A:
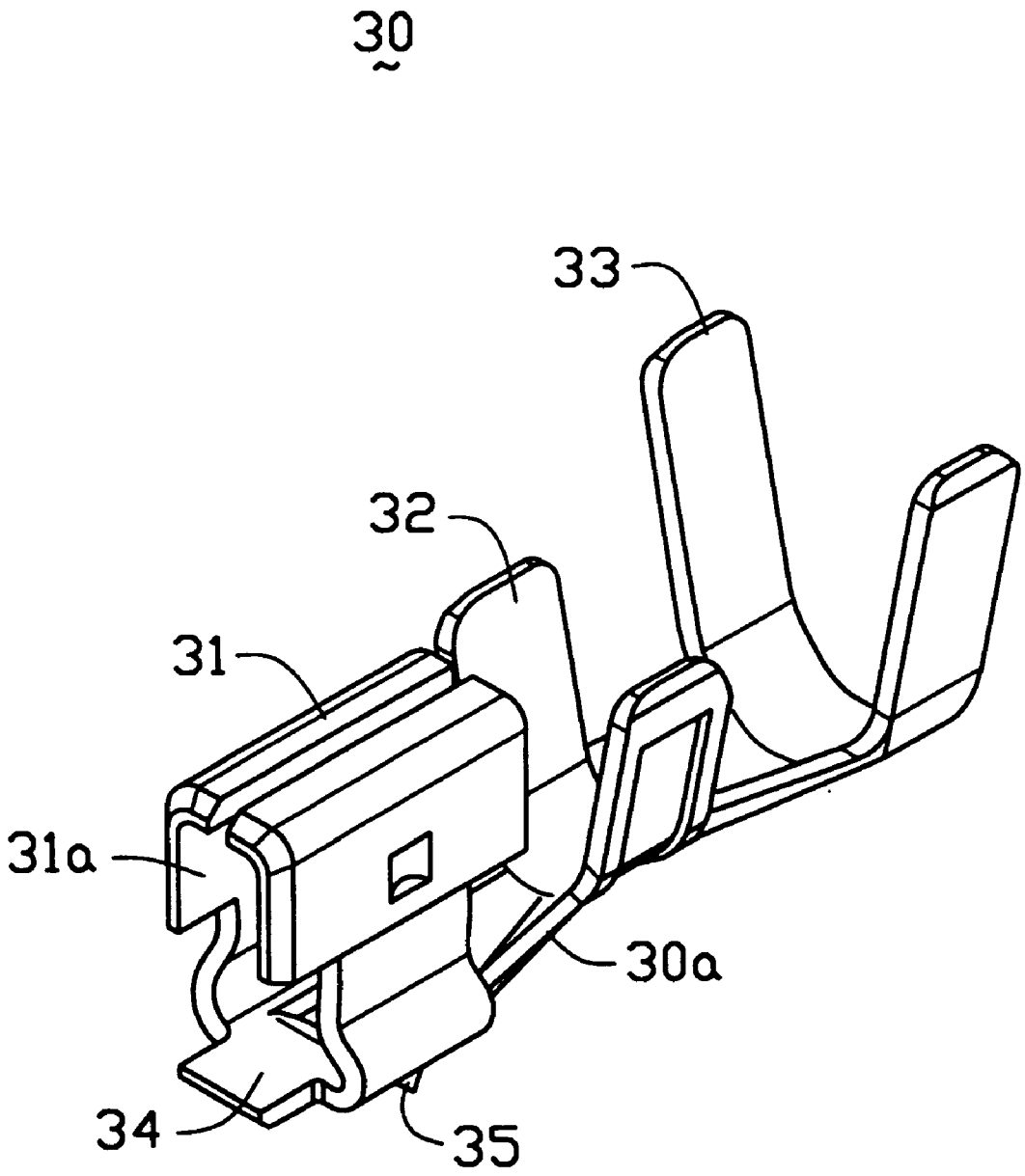
FIG. 2A is a perspective view of a terminal used with the electrical connector in accordance with the present invention.
Figure 2B:
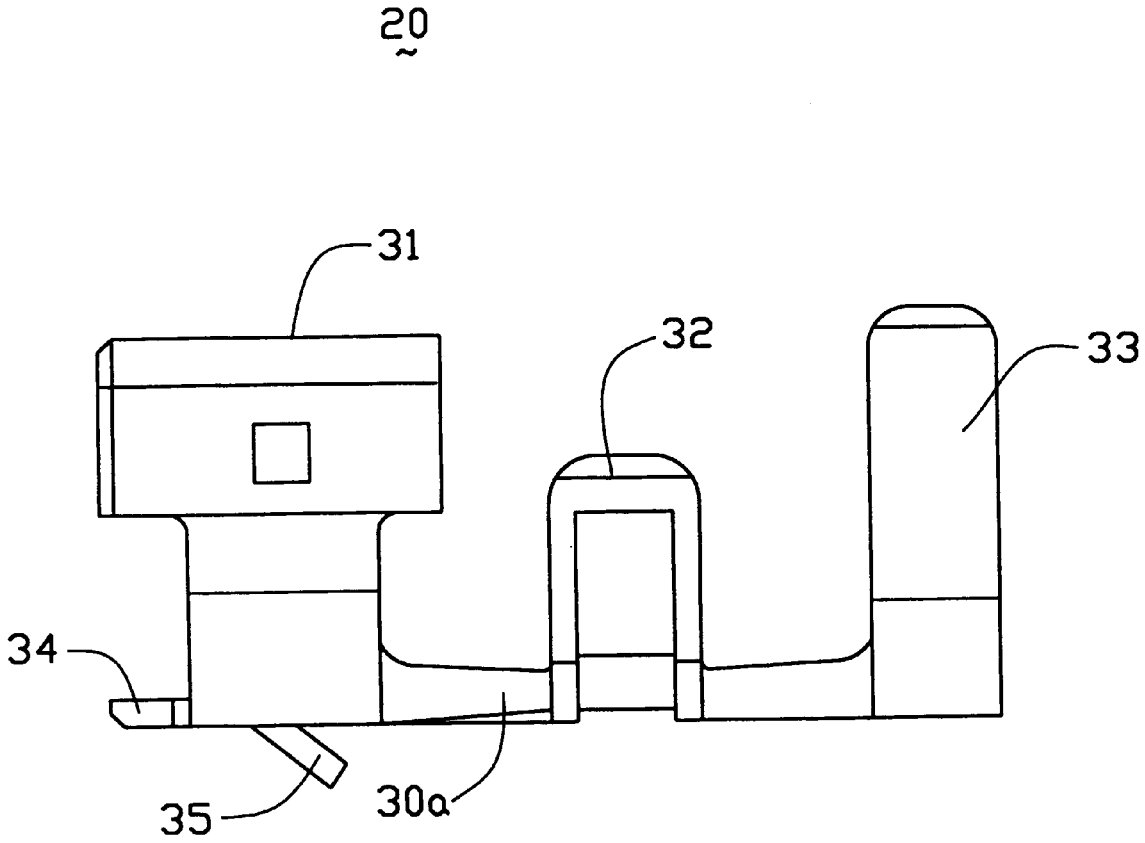
FIG. 2B is a side elevational view of the terminal of FIG. 2A.
Figure 2C:
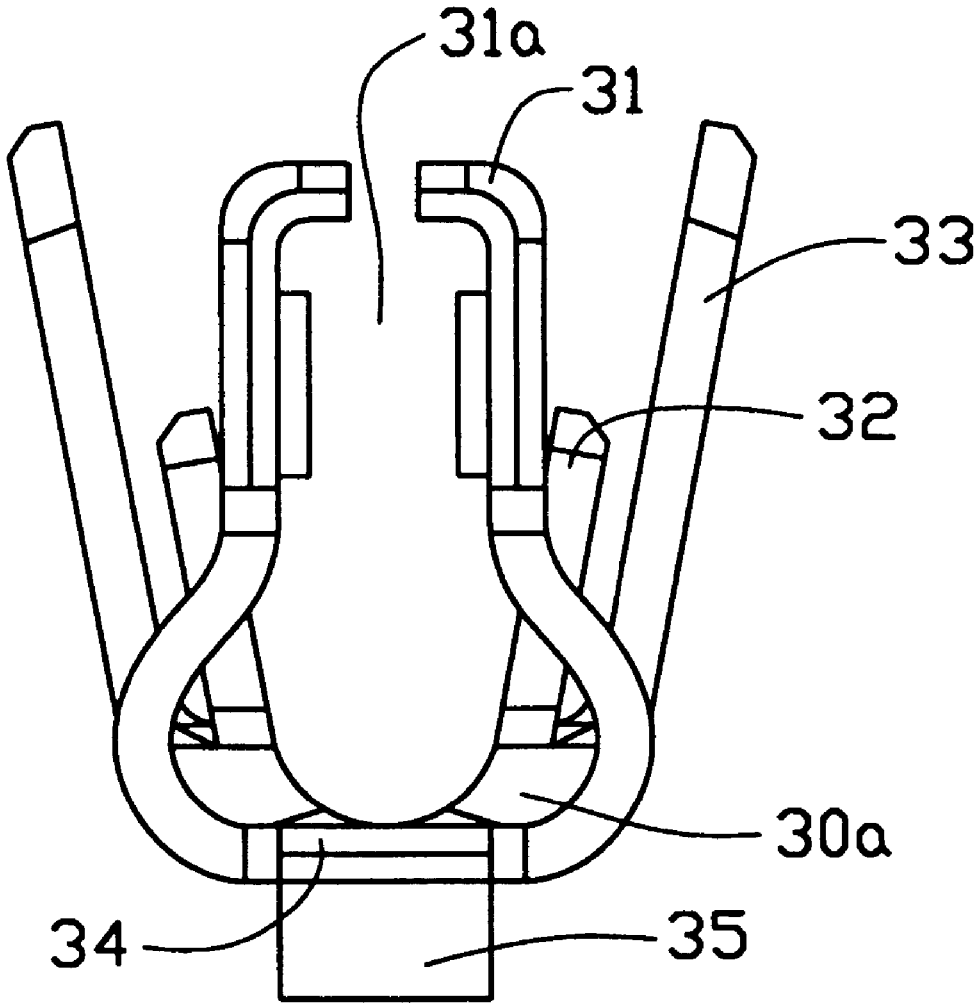
FIG. 2C is a front end view of the terminal.

Referring to FIGS. 2A to 2C, the receptacle terminal 30 includes an elongate base 30*a*. A pair of first resilient arms 31 extends from a front portion of the base 30*a* defines a receiving space 31*a* therebetween for receiving the corresponding pin terminal. The receiving space 31*a* aligns with the front opening 11*b* of the passageway 11. A pair of second resilient arms 32 extends from a middle portion the base 30*a*. The second resilient arms 32 can be deformed to clamp conductors of a conductive wire (not shown). A pair of third resilient arms 33 extends from a rear portion of the base 30*a* for clamping an insulator of the conductive wire. A tongue 34 extends from a front portion of the base 30*a*. An anchoring foot 35 rearwardly extends from the front portion of the base 30*a*.

Figure 1C:
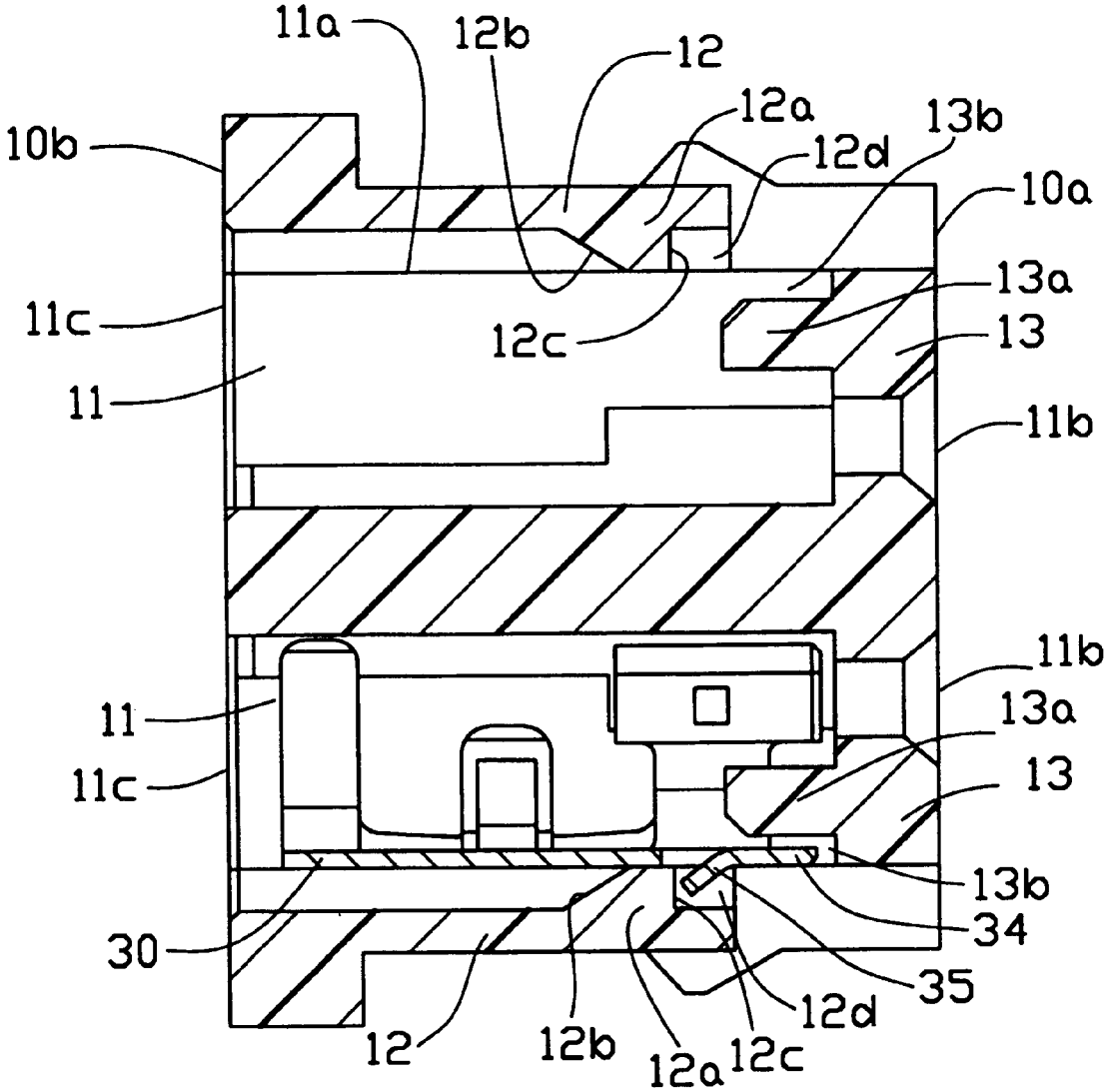
FIG. 1C is a cross sectional view taken along line A—A of FIG. 1A.
Figure 1D:
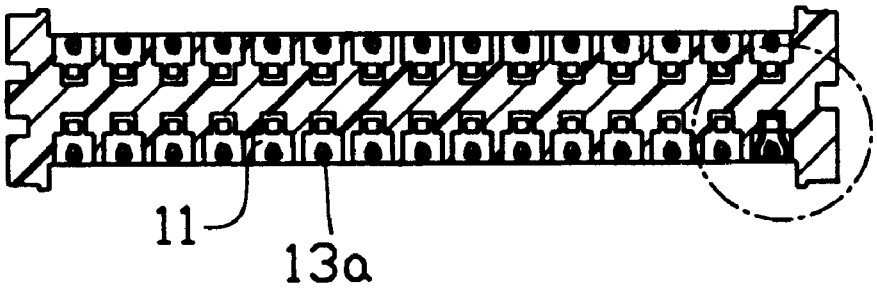
FIG. 1D is a cross sectional view taken along line B—B of FIG. 1B.
Figure 1E:
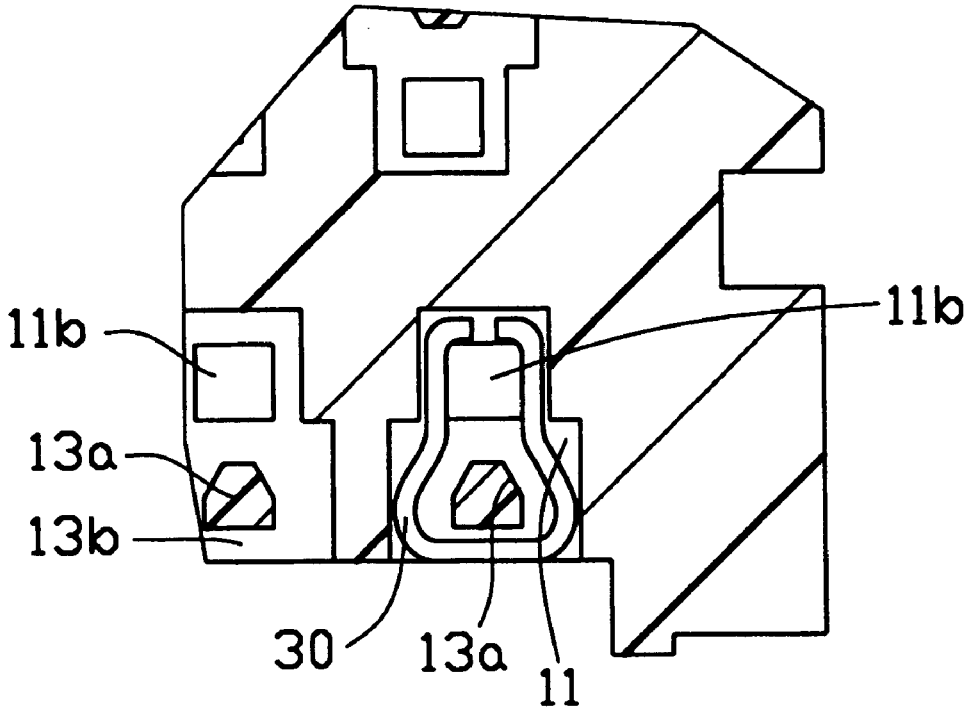
FIG. 1E is an enlarged view of an encircled portion of FIG. 1D.

As shown in FIG. 1C, when the receptacle 30 is inserted into the passageway 11 from the rear opening 11*c*, the anchoring foot 35 slides over the inclined face 12*b* and pushes the flap 12 outward. The anchoring foot 35 is retained within the retaining space 12*d* after the anchoring foot 35 passes the biasing face 12*c*. Meanwhile, the tongue 34 is securely received in the gap 13*b* whereby angular movement of the receptacle terminal 30 is hindered. The flap 12 resumes its original position and the receptacle terminal 30 is securely positioned within the passageway 11.

It should be noted that the restraining engagement between the gap 13*b* and the tongue 34 is positioned close to the anchoring foot 35, which retains the terminal 30 in the housing 10, and to the first resilient arms 31 which engages the corresponding inserted pin terminal of the complementary connector, thus prevents undesired large bending moments from occurring thereto when a force is applied to the anchoring foot 35 or the resilient arms 31. Therefore, a reliable retention of the terminal 30 with regard to the housing 10 without transverse or angular movement is assured.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector for connecting conductors of a conductive wire to a terminal of a complementary connector, comprising:

a dielectric housing having front and rear faces, an array of terminal passageways defined between said front and rear faces, each passageway having front and rear openings, a dam upward extending from said front opening, a wedge rearwardly extending from said dam thereby defining a retaining gap between an inner surface of said passageway and said wedge; and a plurality of receptacle terminals assembled in said terminal passageways, each receptacle terminal having an elongate base, a pair of first resilient arms extending from a front portion of said base and adapted to mate with a corresponding pin terminal of said complementary connector, a pair of second arms extending from a middle portion of said base and adapted for terminating with said conductor of said conductive wire, a pair of third arms extending from a rear portion of said base for retaining an insulator of said conductive wire, and a tongue extending from said front portion for being securely retained within said gap.

2. The electrical connector as recited in claim 1, wherein each said passageway has an open ceiling partially covered by a flap cantilevered forward from a rear face of said housing.

3. The electrical connector as recited in claim 2, wherein said flap forms a block having a leading face and a biasing face.

4. The electrical connector as recited in claim 3, wherein a retaining space is defined between said biasing face and said flap.

5. The electrical connector as recited in claim 4, wherein said receptacle terminal includes an anchoring foot which can be securely retained within said retaining space when said receptacle is assembled in said passageway.

6. An electrical connector, comprising:

a dielectric housing having front and rear faces, an array of terminal passageways defined between said front and rear faces, each of said passageways having front and rear openings;

a plurality of receptacle terminals respectively assembled into said terminal passageways, each of said receptacle terminals including first means for engagement with a corresponding pin terminal of a complementary connector which extends through the front opening of the corresponding passageway, and second means for connecting to a corresponding conductor which extends through the rear opening of the same corresponding passageway, said connector being characterized in that:

a retaining gap is formed in each of said passageways and is properly dimensioned to cooperate with a corresponding tongue integrally formed with each of said receptacle terminals wherein said tongue is received within said gap so that retention of the receptacle within the housing can be enhanced without transverse or angular movement thereof.

7. The connector as recited in claim 6, wherein the gap is formed around the front opening of each corresponding passageway and by an upward extending dam and a corresponding wedge extending rearward from said dam.

8. The connector as recited in claim 7, wherein said tongue extends forward from a front portion of a base of said receptacle terminal.

9. An electrical connector comprising:

a dielectric housing having front and rear faces, an array of terminal passageways defined between said front and rear faces, each of said passageways having front and rear openings;

a plurality of receptacle terminals respectively assembled into said terminal passageways, each of said receptacle terminals including means defining a receiving space for receivable engagement with a corresponding pin terminal of a complementary connector which extends through the front opening of the corresponding passageway, said connector being characterized in that:

a dam upward extends from the front opening of each of the passageways, and a wedge extends rearward from the dam thereby extending into and engaged with said receiving space of the terminal for restraining transverse or angular movement of the terminal in the corresponding passageway.

10. The connector as recited in claim 9, wherein an anchoring foot is disposed proximate the corresponding wedge.

11. An electrical connector comprising:

a dielectric housing having front and rear faces, an array of terminal passageways defined between said front and rear faces, each of said passageways having front and rear openings;

a plurality of receptacle terminals respectively assembled into said terminal passageways along a lengthwise direction thereof from the rear opening to the front opening, said connector being characterized in that:

a retaining gap is formed in each of said passageways around the corresponding front opening and is properly dimensioned to cooperate with a corresponding tongue integrally extending from a front portion of each of said receptacle terminals wherein said tongue is received within said gap so that retention of the receptacle terminal within the housing can be enhanced without transverse or angular movement thereof.

* * * * *